US010912359B2

(12) United States Patent
Wu

(10) Patent No.: US 10,912,359 B2
(45) Date of Patent: Feb. 9, 2021

(54) PORTABLE PROTECTION CASE AND DISPLAY

(71) Applicants: BenQ Intelligent Technology (Shanghai) Co., Ltd, Shanghai (CN); BENQ CORPORATION, Taipei (TW)

(72) Inventor: Ho-Shih Wu, Taipei (TW)

(73) Assignees: BenQ Intelligent Technology (Shanghai) Co., Ltd, Shanghai (CN); BENQ CORPORATION, Taipei (TW)

( * ) Notice: Subject to any disclaimer, the term of this patent is extended or adjusted under 35 U.S.C. 154(b) by 0 days.

(21) Appl. No.: 16/785,773

(22) Filed: Feb. 10, 2020

(65) Prior Publication Data

US 2020/0367622 A1 Nov. 26, 2020

(30) Foreign Application Priority Data

May 21, 2019 (CN) ..... 2019 1 0425668

(51) Int. Cl.
*A45C 11/00* (2006.01)
*A45C 13/00* (2006.01)

(52) U.S. Cl.
CPC ..... *A45C 11/00* (2013.01); *A45C 13/001* (2013.01); *A45C 2011/003* (2013.01)

(58) Field of Classification Search
CPC combination set(s) only.
See application file for complete search history.

(56) References Cited

U.S. PATENT DOCUMENTS 5,445,266 A * 8/1995 Prete ..... G06F 1/1628 206/320
5,908,147 A * 6/1999 Chuang ..... G06F 1/1628 190/100
6,283,299 B1 * 9/2001 Lee ..... G06F 1/1628 206/320
7,876,558 B2 * 1/2011 Daley, III ..... G06F 1/1628 361/679.55
8,371,442 B1 * 2/2013 Pack ..... A45C 11/00 206/320
8,467,176 B2 * 6/2013 Daley, III ..... G06F 1/1628 361/679.03

(Continued)

FOREIGN PATENT DOCUMENTS

CN 104205195 A 12/2014
CN 105715924 A 6/2016

(Continued)

OTHER PUBLICATIONS

Office action of counterpart application by SIPO dated Nov. 5, 2020.

*Primary Examiner* — Lisa Lea-Edmonds

(57) ABSTRACT

A portable protection case and a display are provided. The protection case, adapted to hold a display device, includes a body and a hanger assembly. The body has a surface. The hanger assembly, configured to connect the display device, includes a fixed member, a base, an elastic member and a holder. The fixed member is disposed on the surface of the body. The base is disposed on the fixed member. The elastic member is connected between the fixed member and the base for providing the base with an elastic force. The holder is disposed on the base for holding the display device.

19 Claims, 9 Drawing Sheets

(56) References Cited

U.S. PATENT DOCUMENTS 8,867,199 B2 * 10/2014 Daley, III ..... G06F 1/163 361/679.03
9,078,338 B2 * 7/2015 Ohtaka ..... H04M 1/0202
9,197,794 B2 * 11/2015 Ohtaka ..... G06F 1/1626
9,414,660 B1 * 8/2016 Al-Hasan ..... A45C 5/065
9,442,521 B2 * 9/2016 Daley, III ..... G06F 1/1637
9,538,821 B1 * 1/2017 Al-Hasan ..... A45C 11/00
9,566,704 B1 * 2/2017 Stoikos ..... B25H 3/06
9,603,428 B1 * 3/2017 Al-Hasan ..... G06F 1/1662
9,750,321 B2 * 9/2017 Kandel ..... A45C 13/02
10,389,398 B1 * 8/2019 Garcia ..... A45C 13/005
2005/0072824 A1 * 4/2005 Lee ..... B60R 7/043 224/585
2011/0011760 A1 * 1/2011 Habersetzer ..... G06F 1/1628 206/320
2012/0106055 A1 * 5/2012 Daley, III ..... G06F 1/163 361/679.03
2013/0220856 A1 * 8/2013 Roach ..... A61N 1/3968 206/363
2014/0057246 A1 * 2/2014 Parks ..... A45C 9/00 434/382
2015/0060325 A1 * 3/2015 Ebe ..... B65D 5/4204 206/773
2015/0114880 A1 * 4/2015 Hough ..... B65D 5/5213 206/755
2015/0271305 A1 * 9/2015 Ohtaka ..... G06F 1/1628 455/575.8
2016/0157572 A1 * 6/2016 Brilmyer ..... A62C 3/00 206/557
2016/0206063 A1 * 7/2016 Fenton ..... A45C 11/00
2016/0206064 A1 * 7/2016 Chen ..... A45C 11/00
2016/0209881 A1 * 7/2016 Fenton ..... A45C 11/00
2016/0355299 A1 * 12/2016 Lapoint ..... B65D 25/04
2016/0357219 A1 * 12/2016 Daley, III ..... G06F 1/1637
2017/0049201 A1 * 2/2017 Moreau ..... A45F 5/021
2018/0294831 A1 * 10/2018 Richardson ..... H04M 1/0202
2020/0041147 A1 * 2/2020 Goldie ..... F24F 5/0021
2020/0163426 A1 * 5/2020 Ungar ..... A45C 13/262

FOREIGN PATENT DOCUMENTS

CN 205678399 U 11/2016
CN 205795118 U 12/2016

* cited by examiner

21

PORTABLE PROTECTION CASE AND DISPLAY

This application claims the benefit of People's Republic of China Application No. 201910425668.3, filed May 21, 2019, the disclosure of which is incorporated by reference herein in its entirety.

BACKGROUND OF THE INVENTION

Field of the Invention

The invention relates in general to a protection case and a display, and more particularly to a portable protection case and a display including the portable protection case.

Description of the Related Art

In comparison to the portable display device, ordinary display device (such as liquid crystal display device) is inconvenient to carry, and the users normally will be reluctant to carry such display device when going outside.

However, some users still have the need for carrying such display device when going outside. For example, after professional photographers have finished outdoor photography, they normally need to use a liquid crystal display device with high color accuracy to check whether the colors of the captured images meet the requirements or not. Under such circumstances, they will need a portable protection case and a display including the portable protection case.

SUMMARY OF THE INVENTION

The invention relates to a portable protection case and a display including the portable protection case for avoiding the display device being collided and damaged during the handling process.

According to an embodiment of the present invention, a portable protection case is provided. The protection case, adapted to hold a display device, includes a body and a hanger assembly. The body has a surface. The hanger assembly, configured to connect the display device, includes a fixed member, a base, an elastic member and a holder. The fixed member is disposed on the surface of the body. The base is disposed on the fixed member. The elastic member is connected between the fixed member and the base for providing the base with an elastic force. The holder is disposed on the base for holding the display device.

According to another embodiment of the present invention, a display is provided. The display includes a display device and a portable protection case. The display device has a display surface and a rear surface opposite to the display surface. The portable protection case includes an upper cover, a pivotal mechanism and a lower cover. A hanger assembly is disposed on the upper cover. The lower cover is connected to the upper cover through the pivotal mechanism. When the upper cover is folded up with the lower cover, an accommodation space for receiving the display device is formed between the upper cover and the lower cover. When the upper cover is unfolded with respect to the lower cover, the rear surface of the display device is selectively connected to the hanger assembly.

The above and other aspects of the invention will become better understood with regards to the following detailed description of the preferred but non-limiting embodiment(s). The following description is made with reference to the accompanying drawings.

DETAILED DESCRIPTION OF THE INVENTION

A number of embodiments of the invention are disclosed below with accompanying drawings. For the invention to be understood clearly, many details of practices are explained in the following disclosure. However, it should be understood that the details of practices are not for limiting the invention. That is, in some embodiments of the invention, the details of practices are not necessary. To simplify the drawings, some generally known structures and elements are schematically illustrated. Unless otherwise specified, element designations common to different drawings can be regarded as corresponding elements. These drawings are for describing the connection relationship between the elements of the embodiments, and the dimension scales used in the accompanying drawings are not based on actual proportion of the elements.

Figure 1:
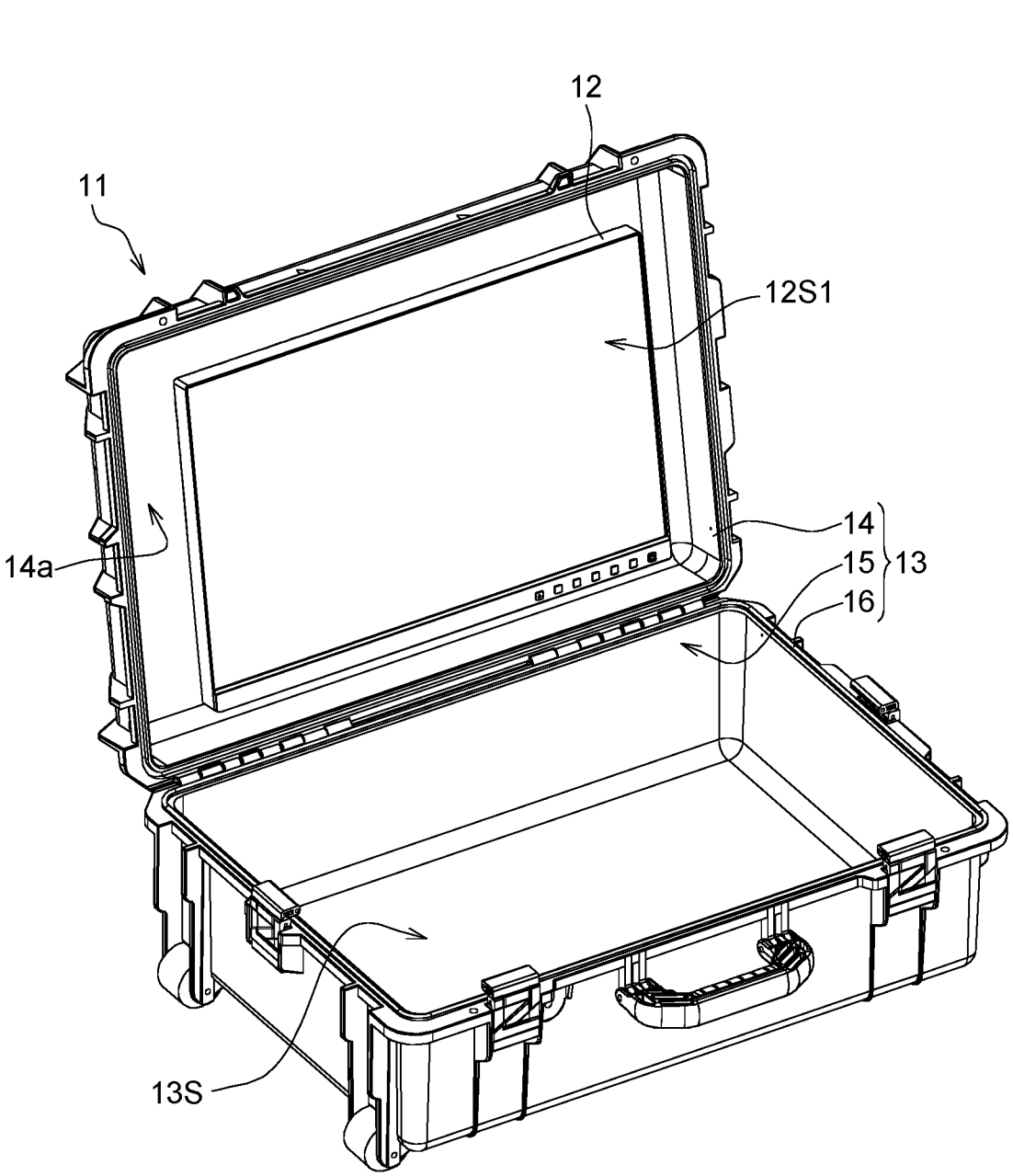
FIG. 1 is a 3D diagram of a display according to an embodiment of the invention.
Figure 2:
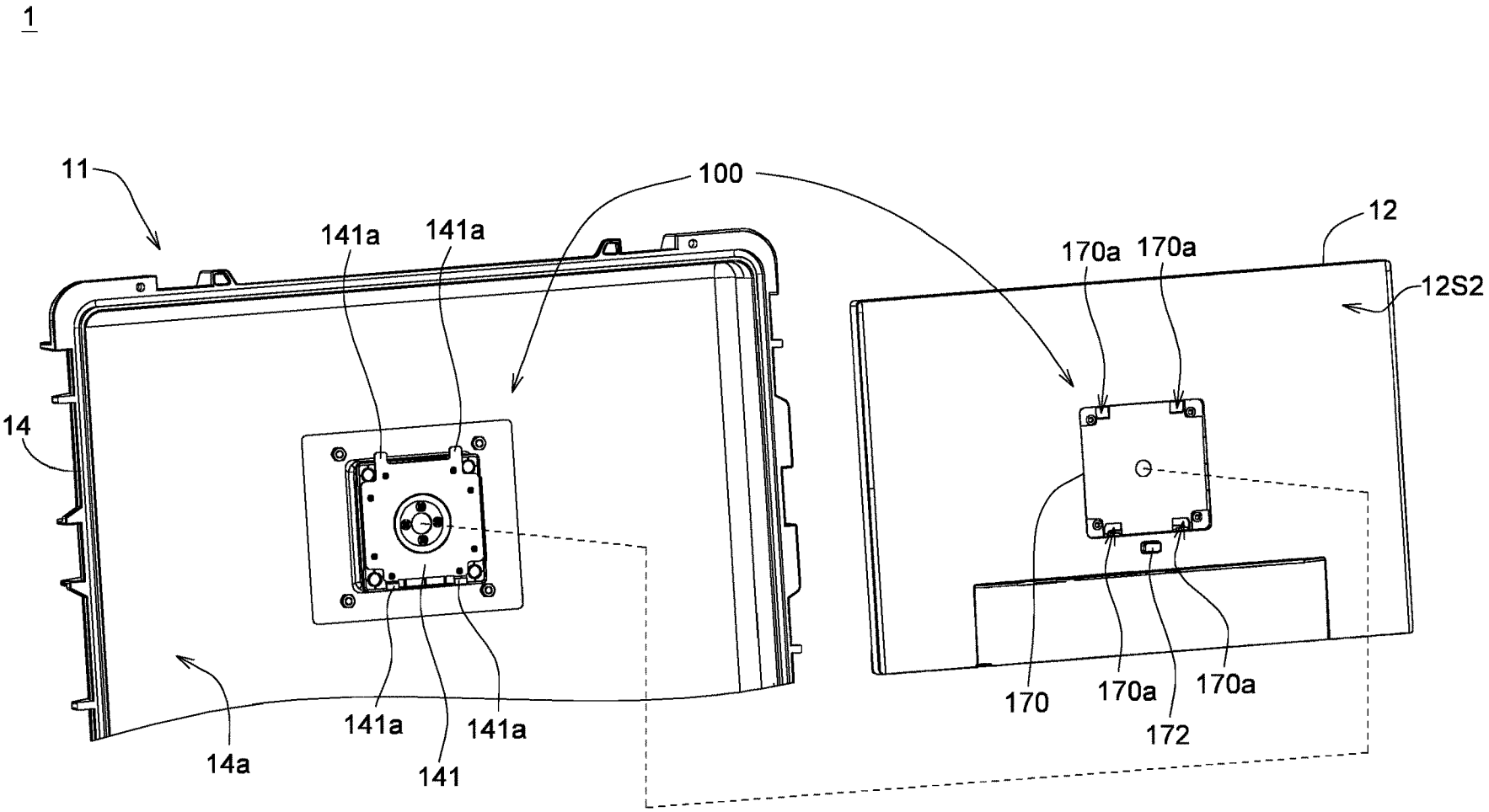
FIG. 2 is an assembly diagram of a display device and a portable protection case of the display according to an embodiment of the invention.

FIG. 1 is a 3D diagram of a display 1 according to an embodiment of the invention. FIG. 2 is an assembly diagram of a display device 12 and a portable protection case 11 of the display 1 according to an embodiment of the invention.

As indicated in FIG. 1 and FIG. 2, the display 1 includes a portable protection case 11 and a display device 12. The portable protection case 11 includes a body 13 (illustrated in FIG. 1) and a hanger assembly 100 (illustrated in FIG. 2). The body 13 may be the body structure of a luggage, an equipment case, a trolley case or a portable case, and includes an upper cover 14, a pivotal mechanism 15 and a lower cover 16. The upper cover 14 is connected between the lower cover 16, the pivotal mechanism 15 through a pivotal mechanism 15, such as a hinge element, which enables the upper cover 14 to rotate with respect to the lower cover 16 to enter an open state or a close state.

The body 13 has an accommodation space 13S. When the upper cover 14 is rotated through the pivotal mechanism 15 to be folded up with the lower cover 16, an accommodation space 13S is formed between the upper cover 14 and the lower cover 16 for receiving and protecting the display device 12.

The display device 12 may further be selectively installed on the portable protection case 11 for the user's convenience of use. The display device 12 has a display surface 12S1 and a rear surface 12S2 opposite to the display surface 12S1. The rear surface 12S2 of the display device 12 may be selectively connected to the hanger assembly 100, such that the display device 12 may be disposed on the portable protection case 11.

The hanger assembly 100 is disposed on a surface 14*a* of the body 13 for connecting the display device 12. In some embodiments, the surface 14*a* may be an inner surface or an outer surface of the body 13. For example, the surface 14*a* is an inner surface of the upper cover 14 or the lower cover 16 that faces the accommodation space 13S. Thus, when the upper cover 14 is folded up with the lower cover 16, the display device 12 may be received in the accommodation space 13S and protected by the body 13. Conversely, when the upper cover 14 is rotated and unfolded with respect to the lower cover 16 through the pivotal mechanism 15, the body 13 may also be used as a carrier of the display device 12 and may be viewed by the user directly.

In the following embodiments, the hanger assembly 100 is exemplarily disposed on an inner surface (designated by the surface 14*a*) of the body 13. However, the surface 14*a* is not limited to an inner surface of the body 13. In other embodiments, the surface 14*a* may be an outer surface of the body 13. Thus, the user may carry the display device 12 through the portable protection case 11.

Figure 3A:
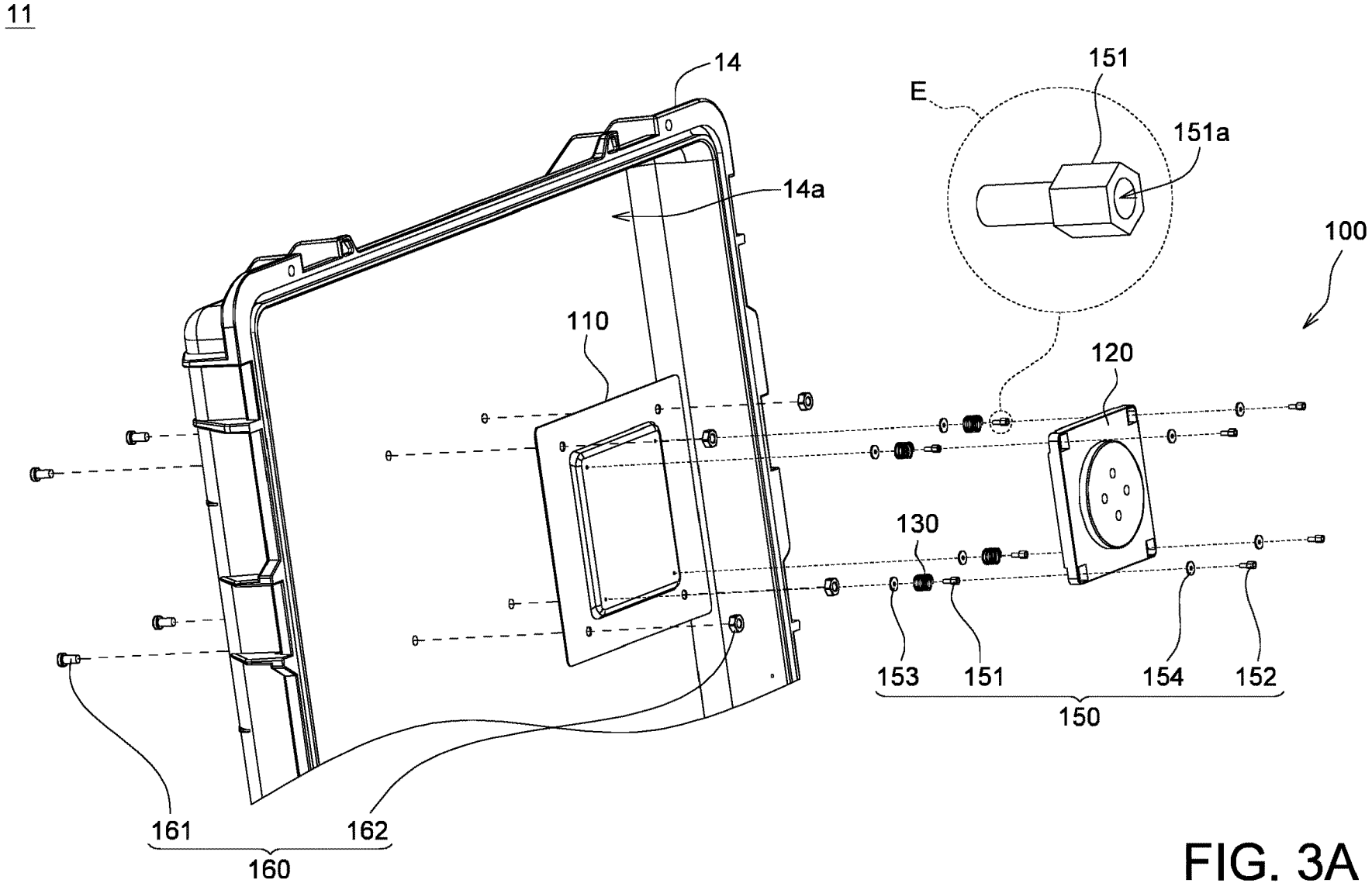
FIG. 3A is an explosion diagram of some elements of the portable protection case of FIG. 2.
Figure 3B:
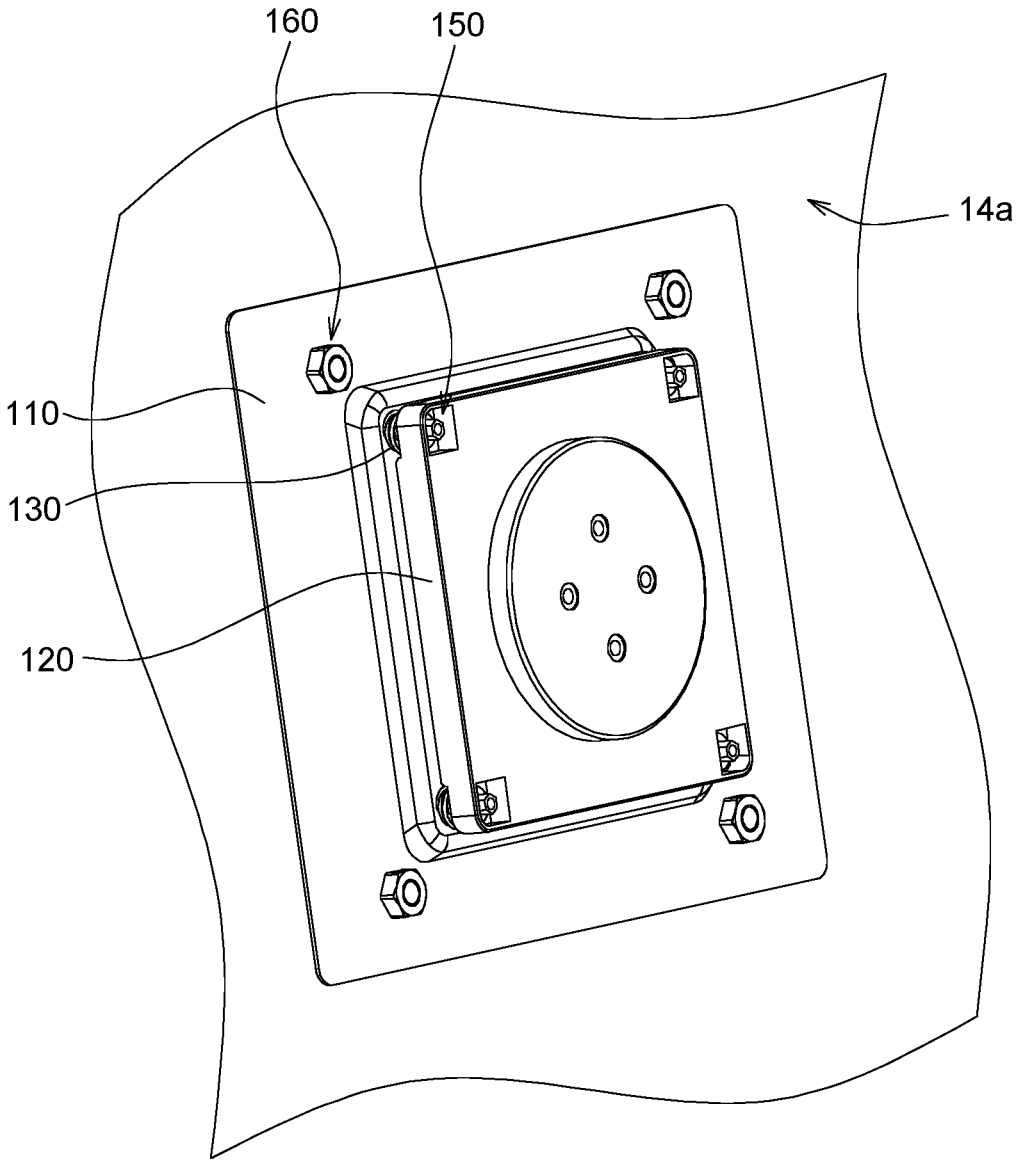
FIG. 3B is an assembly diagram of some elements of the portable protection case of FIG. 3A.
Figure 4:
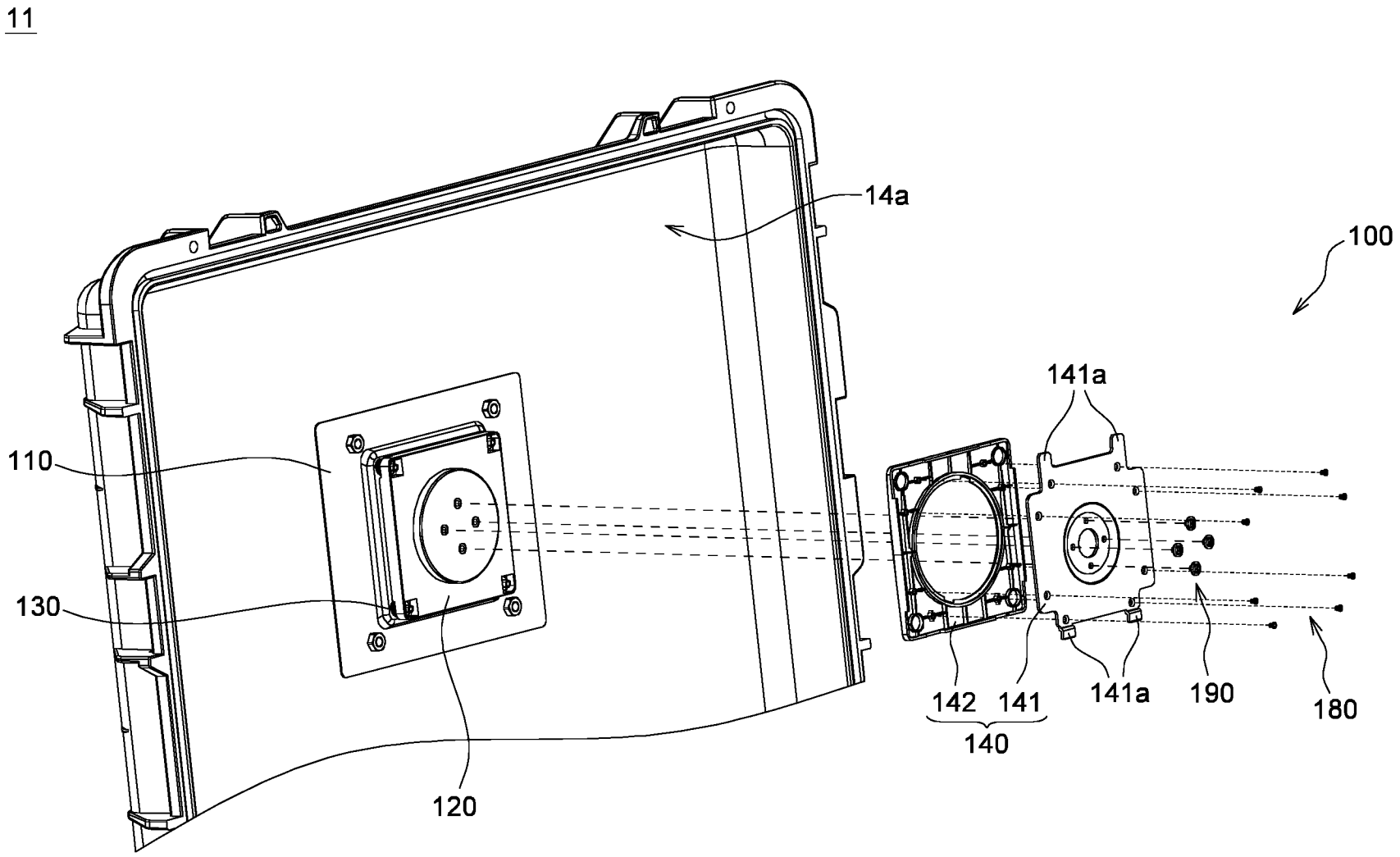
FIG. 4 is an explosion diagram of some elements and remaining elements of the portable protection case of FIG. 3B.

FIG. 3A is an explosion diagram of some elements of the portable protection case 11 of FIG. 2. FIG. 3B is an assembly diagram of some elements of the portable protection case 11 of FIG. 3A. FIG. 4 is an explosion diagram of some elements and remaining elements of the portable protection case 11 of FIG. 3B.

Refer to FIG. 2, FIG. 3A, FIG. 3B and FIG. 4. The hanger assembly 100 includes a fixed member 110, a base 120, an elastic member 130 and a holder 140. The fixed member 110 is disposed on the surface 14*a* of the upper cover 14. The base 120 is disposed on the fixed member 110. The elastic member 130 is connected between the fixed member 110 and the base 120 for providing the base 120 with an elastic force. The holder 140 may be fixed to the base 120 for holding the display device 12.

Refer to FIG. 3A and FIG. 3B. In the present embodiment, the fixed member 110 is a thin plate. The hanger assembly 100 may further include a connection assembly 160 through which the fixed member 110 may be fixed on the surface 14*a*. The connection assembly 160 may be any element or structure capable of fixing the fixed member 110 on the surface 14*a*. For example, the connection assembly 160 may include pleural sets of screws 161 and nuts 162. The screws 161 may pass through the upper cover 14 and the fixed member 110 from the outer surface of the upper cover 14 to be fastened to the nut 162 and cause the fixed member 110 to be fixed on the surface 14*a*, but the invention is not limited thereto.

The hanger assembly 100 may further include a fixing assembly 150. The fixing assembly 150 passes through the base 120 and the elastic member 130 to be fixed on the fixed member 110 and cause the elastic member 130 to lean on the fixed member 110 and the base 120.

In an embodiment, as indicated in FIG. 3A, the fixing assembly 150 may include a first plug 151 and a second plug 152, and may additionally include pads 153 and 154, but the invention is not limited thereto. As indicated in an enlarged view of the structure of the first plug 151 (the enlarged portion E of FIG. 3A), the first plug 151 further has a hole 151*a*. The hole 151*a* may have any shape, but is exemplified by a circular shape here. The shape of the second plug 152 is adapted to the hole 151*a*.

Firstly, the first plug 151 passes through the elastic member 130 and the pad 153 to be fixed on the fixed member 110. Then, the second plug 152 passes through the pad 154 and the base 120 to be inserted into the hole 151*a* of the first plug 151. The second plug 152 or the pad 154 may lean on the base 120 in a direction towards the surface 14*a* and cause the base 120 to lean on the elastic member 130. Thus, the elastic member 130 may lean on the fixed member 110 and the base 120 through the fixing assembly 150 for providing the base 120 with an elastic force.

Refer to FIG. 4. Then, the holder 140 is disposed on the base 120. The holder 140 may include a supporting plate 141 and may additionally include a bottom plate 142, but the invention is not limited thereto. The supporting plate 141 is connected to the bottom plate 142 through such as a set of screws 180. After that, the holder 140 is fixed on the base 120 through another set of screws 190 passing through the supporting plate 141.

Refer to FIG. 2 and FIG. 4. The hanger assembly 100 may further include an assembly member 170 adapted to be disposed on a rear surface 12S2 of the display device 12. In the present embodiment, the assembly member 170 may be formed on the rear surface 12S2 of the display device 12, but the invention is not limited thereto.

The supporting plate 141 includes pleural positioning protrusions 141*a*. Correspondingly, the assembly member 170 has pleural positioning notches 170*a* whose positions and quantity correspond to that of the positioning protrusions 141*a*. The positioning protrusions 141*a* may be engaged with corresponding positioning notches 170*a*. Thus, the display device 12 may be supported by the holder 140. Conversely, when the display device 12 needs to be detached from the holder 140, the engagement between the positioning protrusions 141*a* and the positioning notches 170*a* may be released through the release button 172 disposed on the rear surface 12S2 of the display device 12.

Given that the display device 12 is connected to the hanger assembly 100, the disposition of the elastic member 130 avoids the display device 12 being collided and damaged during the handling process.

Refer to FIG. 2, FIG. 3B and FIG. 4. During the handling process of the display device 12, the display device 12 may wobble easily and apply a force to the holder 140 and the base 120. When the base 120 receives a force and moves along the normal direction of the surface 14*a*, the elastic member 130 will store an elastic force. When the base 120 no more receives any force, the elastic member 130 will release the stored elastic force, which causes the base 120 to move back and forth along the normal direction of the surface 14*a*. Thus, the elastic member 130 may provide a buffer between the base 120 and the holder 140 (illustrated in FIG. 4) or even to the display device 12 coupled to the holder 140 (illustrated in FIG. 2) to avoid these hard structures colliding and damaging the display device 12.

Figure 5:
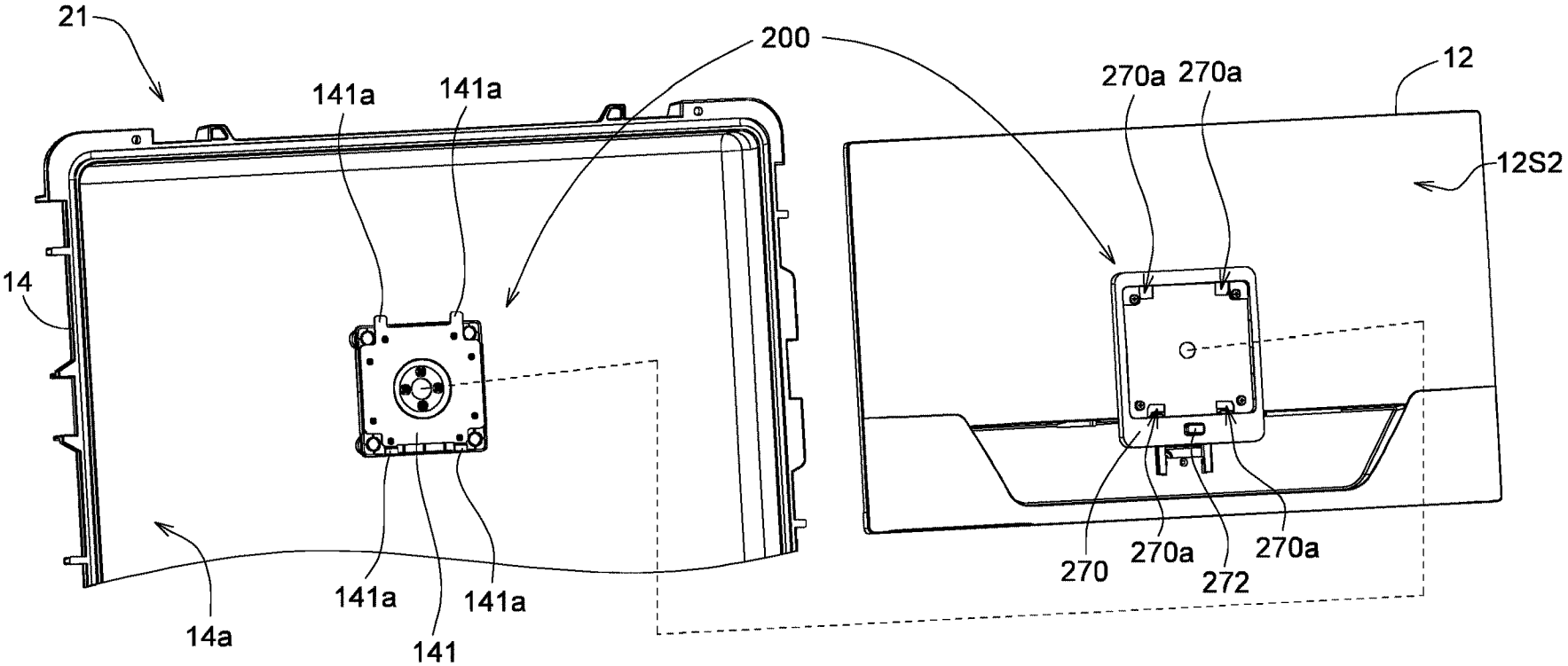
FIG. 5 is an assembly diagram of a display device and a portable protection case of a display according to another embodiment of the invention.

FIG. 5 is an assembly diagram of a display device 12 and a portable protection case 21 of a display 2 according to another embodiment of the invention. The embodiment of FIG. 5 is different from the embodiment of FIG. 2 only in the hanger assembly 200 of the portable protection case 21. The difference between embodiment of FIG. 5 and the embodiment of FIG. 2 is disclosed below, and the similarities are not repeated here.

Refer to FIG. 5. The hanger assembly 200 may include an assembly member 270. The assembly member 270 includes a release button 272, and has pleural positioning notches 270*a*. The assembly member 270 is an additional element disposed on the rear surface 12S2 of the display device 12. The assembly member 270 has pleural installation holes complying with the Video Electronics Standards Association (VESA) specification, and therefore is adapted to any display device 12 complying with the VESA specification. However, the assembly member 270 and the assembly member 170 of FIG. 2 are mutually replaceable, and the invention does not have specific restrictions regarding to the said design.

Figure 6A:
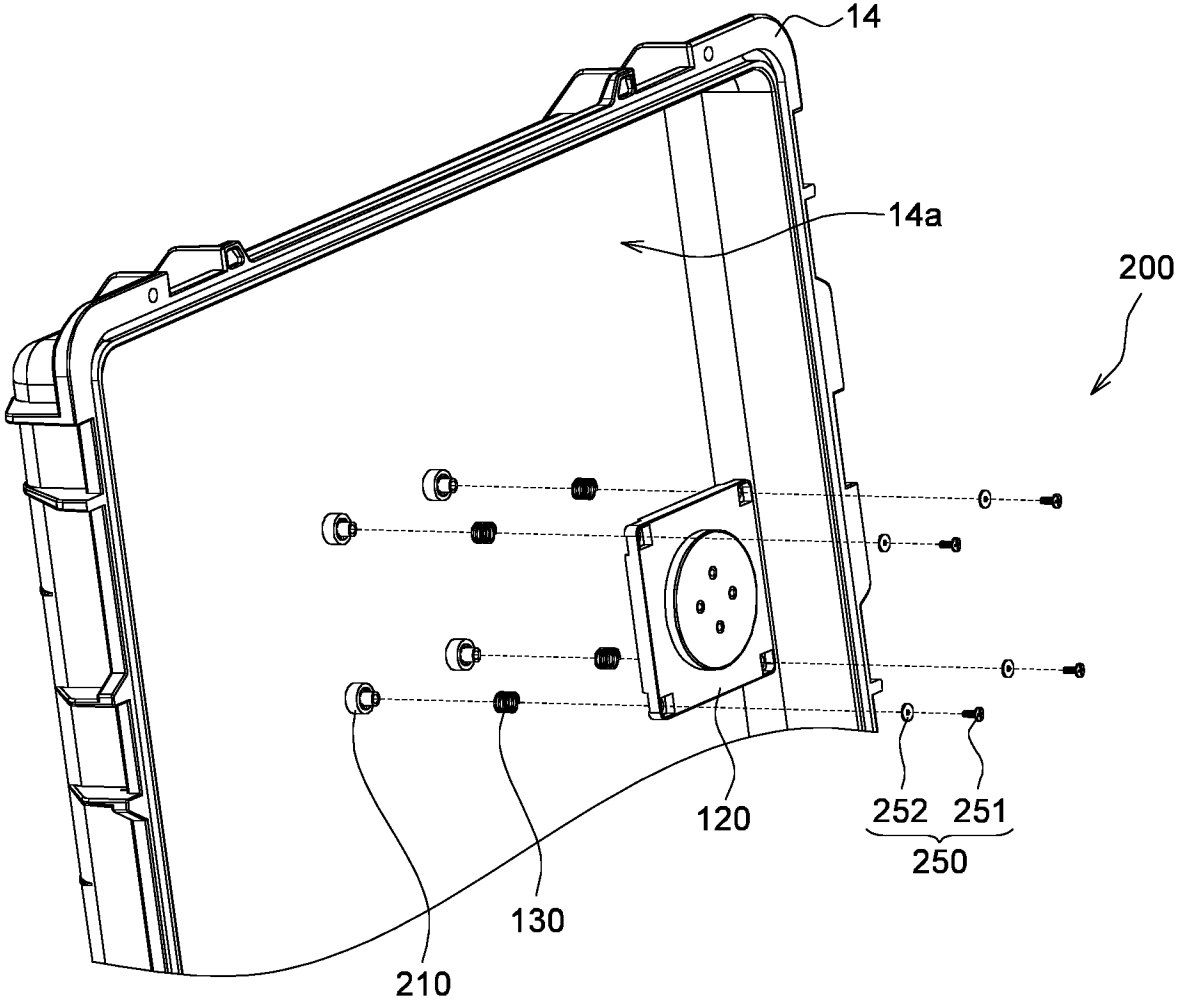
FIG. 6A is an explosion diagram of some elements of the portable protection case of FIG. 5.
Figure 6B:
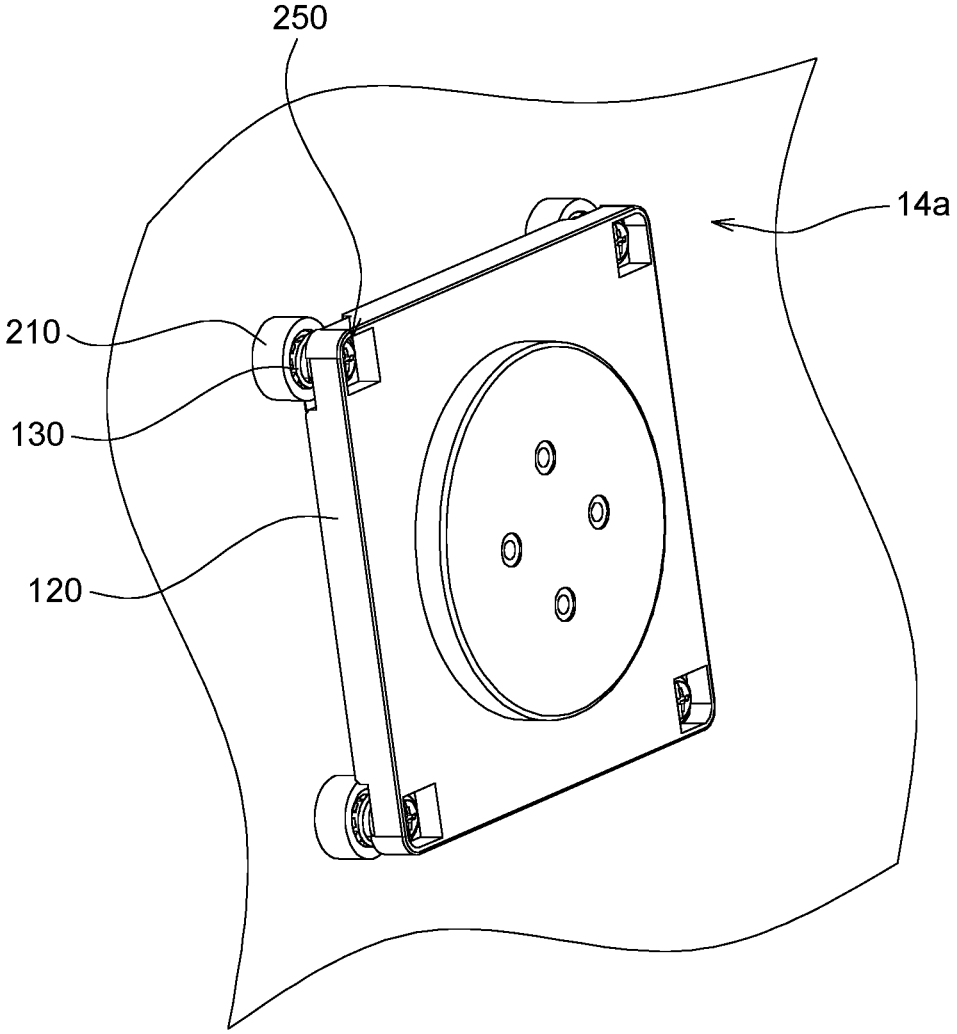
FIG. 6B is an assembly diagram of some elements of the portable protection case of FIG. 6A.
Figure 7:
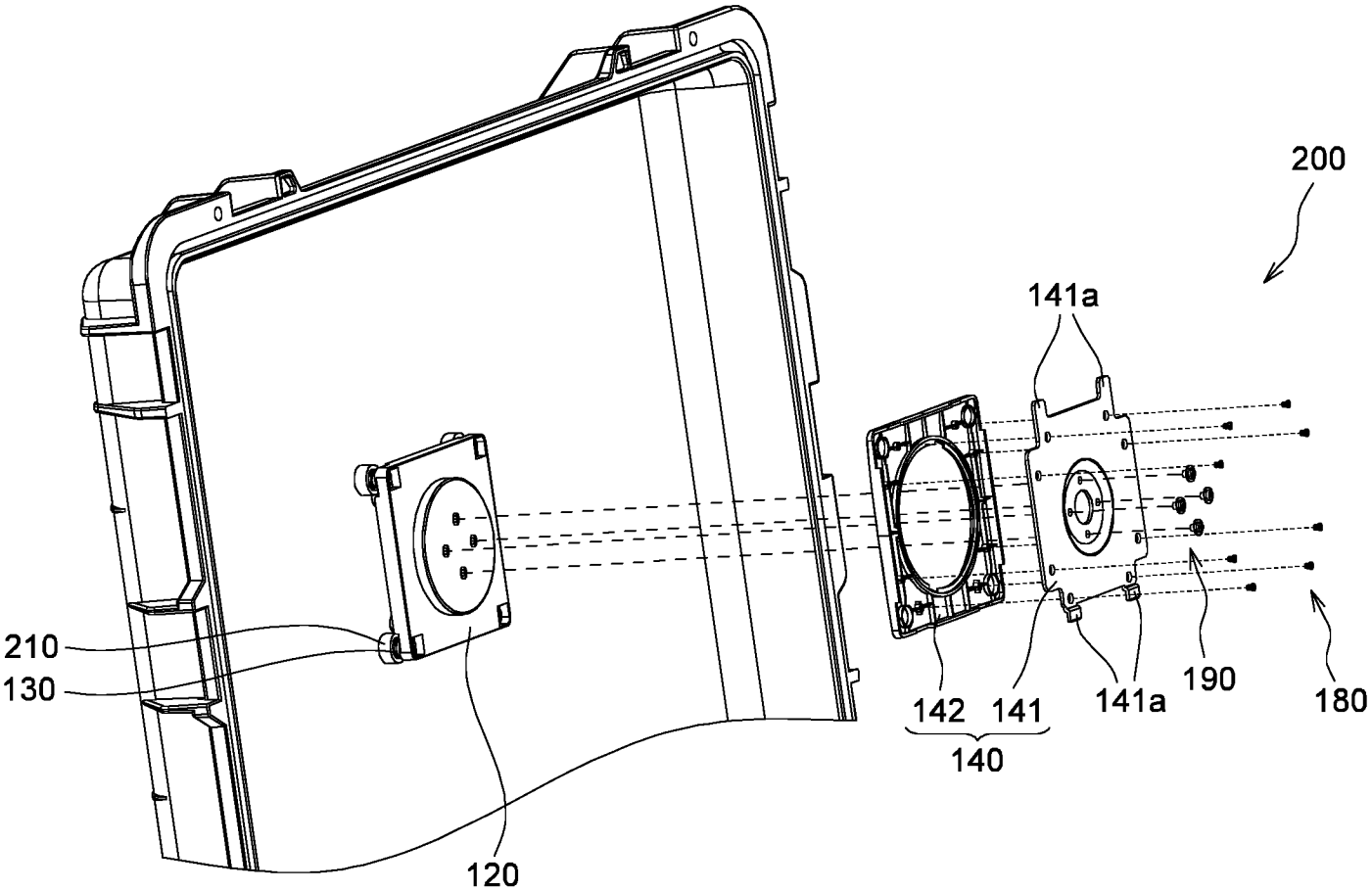
FIG. 7 is an explosion diagram of some elements and remaining elements of the portable protection case of FIG. 6B.

FIG. 6A is an explosion diagram of some elements of the portable protection case 21 of FIG. 5. FIG. 6B is an assembly diagram of some elements of the portable protection case 21 of FIG. 6A. FIG. 7 is an explosion diagram of some elements and remaining elements of the portable protection case 21 of FIG. 6B.

Refer to FIG. 6A and FIG. 6B. In the present embodiment, the fixed member 210 is integrally formed on the surface 14*a* in one piece. In comparison to the embodiment of FIG. 3A, the present embodiment may dispense with the disposition of the connection assembly 160 without affecting the aesthetic appearance of the upper cover 14.

The hanger assembly 200 may include a fixing assembly 250, which passes through the base 120 and the elastic member 130 to be fixed on the fixed member 210 and cause the elastic member 130 to lean on the fixed member 210 and the base 120.

In an embodiment, as indicated in FIG. 6A, each fixing assembly 250 includes a screw 251 or may additionally include a pad 252, but the invention is not limited thereto. The fixed member 210 may have pleural screw holes. The screw 251 passes through the pad 252, the base 120 and the elastic member 130 to be fastened to the screw holes of the fixed member 210. The screw 251 or the pad 252 may lean on the base 120 in a direction towards the surface 14*a* and cause the base 120 to lean on the elastic member 130. Thus, the elastic member 130 may lean on the fixed member 210 and the base 120 through the fixing assembly 250 for providing the base 120 with an elastic force.

Refer to FIG. 5, FIG. 6A, FIG. 6B and FIG. 7. Given that the display device 12 is connected to the hanger assembly 200 the disposition of the elastic member 130 avoids the display device 12 being collided and damaged during the handling process.

According to the portable protection case and the display including the portable protection case disclosed in above embodiments, the portable protection case includes an elastic member connected between the fixed member and the base for providing the base with an elastic force. Thus, the elastic member may provide a buffer between the base and the holder or even the display device coupled to the holder to avoid the display device being collided and damaged when the user handles the display through the portable protection case.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A portable protection case adapted to hold a display device, the protection case comprising:

a body having a surface; and a hanger assembly configured to connect the display device, the hanger assembly comprising:

a fixed member disposed on the surface of the body;

a base disposed on the fixed member;

an elastic member connected between the fixed member and the base for providing the base with an elastic force; and a holder disposed on the base for holding the display device.

2. The protection case according to claim 1, wherein the hanger assembly further comprises:

a fixing assembly passing through the base and the elastic member and fixed on the fixed member to cause the elastic member to lean on the fixed member and the base.

3. The protection case according to claim 2, wherein the fixing assembly comprises:

a first plug passing through the elastic member to be fixed on the fixed member, wherein the first plug has a hole; and a second plug passing through the base to be inserted into the hole of the first plug.

4. The protection case according to claim 2, wherein the fixing assembly comprises a screw passing through the base and the elastic member to be fastened to the fixed member.

5. The protection case according to claim 1, wherein the hanger assembly further comprises:

a connection assembly through which the fixed member is fixed on the surface of the body.

6. The protection case according to claim 1, wherein the fixed member is integrally formed on the surface of the body in one piece.

7. The protection case according to claim 1, wherein the hanger assembly further comprises:

an assembly member having a plurality of positioning notches, wherein the assembly member is adapted to be disposed on the display device;

wherein the holder comprises a supporting plate, the supporting plate comprises a plurality of positioning protrusions corresponding to the positioning notches;

when the holder holds the display device, the positioning protrusions are engaged with corresponding positioning notches.

8. The protection case according to claim 7, wherein the assembly member has a plurality of installation holes complying with the Video Electronics Standards Association specification.

9. The protection case according to claim 7, wherein the assembly member is formed on a rear surface of the display device.

10. The protection case according to claim 1, wherein the body has an accommodation space, and the surface of the body is an inner surface.

11. A display comprising:

a display device having a display surface and a rear surface opposite to the display surface; and a portable protection case comprising:

an upper cover with a hanger assembly disposed thereon, the hanger assembly comprising:

a fixed member disposed on a surface of the upper cover;

a base disposed on the fixed member;

an elastic member connected between the fixed member and the base for providing the base with an elastic force; and a holder disposed on the base and coupled to the rear surface of the display device;

a pivotal mechanism; and a lower cover connected to the upper cover through the pivotal mechanism, wherein when the upper cover is folded up with the lower cover, an accommodation space is formed between the upper cover and the lower cover for receiving the display device; when the upper cover is unfolded with respect to the lower cover, the rear surface of the display device is selectively connected to the hanger assembly.

12. The display according to claim 11, wherein the hanger assembly further comprises:

a fixing assembly passing through the base and the elastic member and fixed on the fixed member to cause the elastic member to lean on the fixed member and the base.

13. The display according to claim 11, wherein the hanger assembly further comprises:

a connection assembly through which the fixed member is fixed on the surface of the upper cover.

14. The display according to claim 11, wherein the fixed member is integrally formed on the surface of the upper cover in one piece.

15. The display according to claim 12, wherein the fixing assembly comprises:

a first plug passing through the elastic member to be fixed on the fixed member, wherein the first plug has a hole; and a second plug passing through the base to be inserted into the hole of the first plug.

16. The display according to claim 12, wherein the fixing assembly comprises a screw passing through the base and the elastic member to be fastened to the fixed member.

17. The display according to claim 11, wherein the hanger assembly further comprises:

an assembly member having a plurality of positioning notches, wherein the assembly member is adapted to be disposed on the rear surface of the display device;

wherein the holder comprises a supporting plate, the supporting plate comprises a plurality of positioning protrusions corresponding to the positioning notches;

when the holder holds the display device, the positioning protrusions are engaged with corresponding positioning notches.

18. The display according to claim 17, wherein the assembly member has a plurality of installation holes complying with the Video Electronics Standards Association specification.

19. The display according to claim 11, wherein the hanger assembly is disposed on an inner surface of the upper cover.

* * * * *